United States Patent [19]

Jingu et al.

[11] Patent Number: 4,951,623

[45] Date of Patent: Aug. 28, 1990

[54] DOUBLE OVERHEAD CAMSHAFT ENGINE

[75] Inventors: Nobuhisa Jingu, Yokohama; Yoshio Iwasa, Nagareyama, both of Japan

[73] Assignee: Nissan Motor Co., Ltd., Japan

[21] Appl. No.: 397,854

[22] Filed: Aug. 24, 1989

[30] Foreign Application Priority Data

Sep. 1, 1988 [JP] Japan ..... 63-114019[U]

[51] Int. Cl.[5] ..... F02F 7/00

[52] U.S. Cl. ..... 123/193 H; 123/195 C; 123/90.27

[58] Field of Search ..... 123/193 H, 195 C, 90.27, 123/90.31

[56] References Cited

U.S. PATENT DOCUMENTS

| | | | |
|---|---|---|---|
| 2,479,617 | 8/1949 | Hawley et al. | 123/90.31 |
| 4,516,546 | 5/1985 | Choushi et al. | 123/193 H |
| 4,553,473 | 11/1985 | Ichida et al. | 123/193 H |
| 4,607,601 | 8/1986 | Kohler | 123/195 C |
| 4,750,455 | 6/1988 | Ebesu | 123/90.27 |
| 4,836,156 | 6/1989 | Inagaki et al. | 123/90.31 |

FOREIGN PATENT DOCUMENTS 60-50208 3/1985 Japan .

*Primary Examiner*—Willis R. Wolfe
*Assistant Examiner*—W. Lo
*Attorney, Agent, or Firm*—Leydig, Voit & Mayer

[57] ABSTRACT

A double overhead camshaft engine having two camshafts rotatably supported by a cylinder head. This two camshafts are drivably connected through an idler gear with a crankshaft of the engine by means of drive chains. The idler gear is rotatably mounted on an idler gear installation bolt which is fixedly secured only to a front end section of the cylinder head in a so-called cantilever arrangement. A surrounding wall structure for the idler gear is formed integral with the front end section of the cylinder head and extends in the direction of axis of the idler gear over the idler gear to form a front end section. An opening is formed at the surrounding wall structrure front end section and located on an opposite side of the cylinder head front end section with respect to the idler gear. The opening is closed with a cover which is disposed spaced from the idler gear installation bolt, so that no connection is made to the idler gear and the installation bolt therefor.

10 Claims, 4 Drawing Sheets

DOUBLE OVERHEAD CAMSHAFT ENGINE

BACKGROUND OF THE INVENTION

1. Field of the Invention

This invention relates to improvements in a double overhead camshaft engine in which intake and exhaust valves are operated by two camshafts, and more particularly to a camshaft driving device including an idler gear through which the camshafts are driven by a crankshaft of the engine.

2. Description of the Prior Art

A variety of camshaft driving devices for double overhead camshaft engines have been proposed and put into practical use. One of these devices is disclosed, for example, in Japanese Patent Provisional Publication No. 60-50208, in which two camshafts are driven by a crankshaft of the engine through an idler gear for deceleration and drive chains. Here, the idler gear is rotatably mounted on an idler gear installation bolt which is disposed bridging the front end section of the cylinder head and a cover disposed independent and spaced from the cylinder head front end section.

Thus, in the above conventional camshaft driving device, the idler gear installation bolt is supported in bolt holes in the cylinder head front end section and in the cover. Therefore, the following difficulties have been encountered in the conventional camshaft driving device, in which the bolt holes for the idler gear installation bolt in the cylinder block front end section and the cover become eccentric with each other under thermal deformation of the cover and by assembly error of the camshaft driving device. This causes oil leak from the bolt hole in the cover. Additionally, the cover obstructs the operator's ken during assembly of the idler gear in the camshaft driving device, so that positioning between the timing marks of the idler gear and a drive chain becomes difficult thereby causing disorder in opening and closing timings of intake and exhaust valves.

SUMMARY OF THE INVENTION

It is an object of the present invention to provide an improved double overhead camshaft engine including a chamshaft driving device by which oil leak from a cover for an idler gear can be prevented while making possible to precisely set the opening and closing timings of intake and exhaust valves.

A double overhead camshaft engine of the present invention is comprised of a cylinder head by which two camshafts are rotatably supported. The two camshafts are drivably connected through an idler gear with a crankshaft of the engine. The idler gear is rotatably mounted on a idler gear installation bolt which is fixedly secured only to the front end section of the cylinder head. A surrounding wall structure is disposed around the idler gear and extends from the cylinder head end section in a direction of axis of the idler gear over the idler gear to form front end section. This surrounding wall structure front end section defines an opening located on an opposite side of the cylinder head front end section with respect to the idler gear. Additionally, a cover is detachably disposed to close the opening of the surrounding wall structure front end section. The cover is spaced from the idler gear installation bolt.

By virtue of the idler gear installation bolt supported in a cantilever arrangement, the idler gear and the installation bolt are in no connection with the cover and therefore they are spaced from the cover. As a result, no oil leak occurs in the cover. Additionally, positioning between the timing marks of the idler gear and drive chains is precisely accomplished through the opening in the surrounding wall structure front end section which opening ensures an operator's wide ken during assembly of the engine. This makes possible to presisely set the opening and closing timings of intake and exhaust valves of the engine.

DETAILED DESCRIPTION OF THE INVENTION

Figure 1:
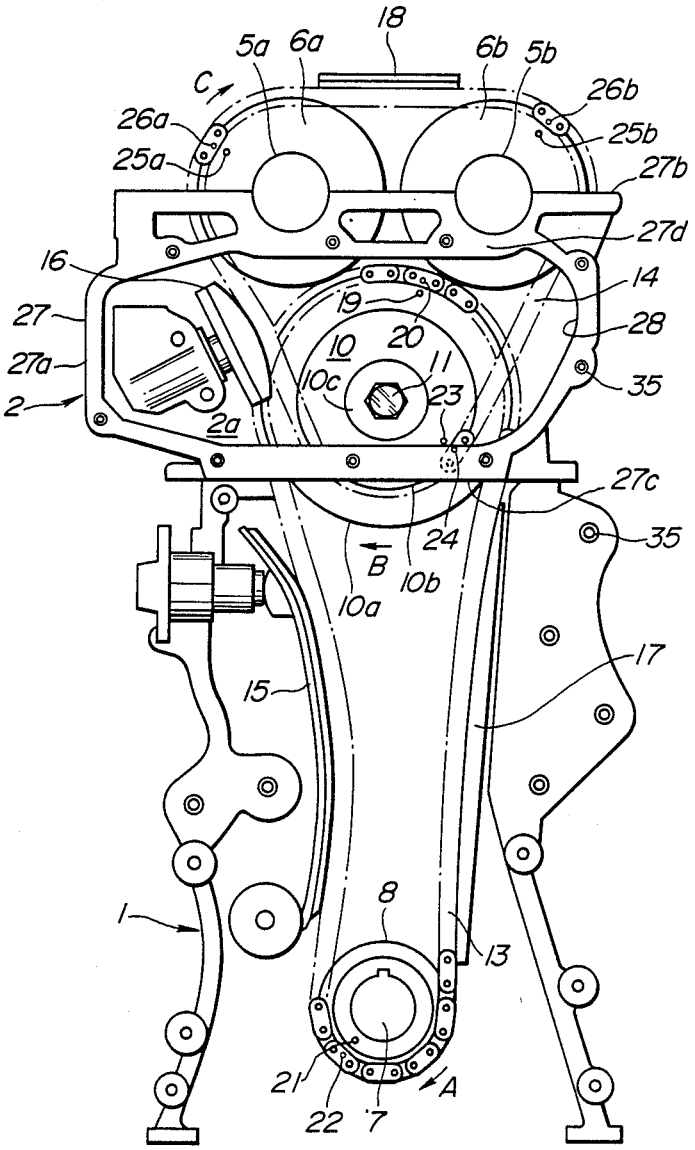
FIG. 1 is a front elevation of an embodiment of a double overhead camshaft engine in accordance with the present invention.

Referring now to FIGS. 1 to 4, there is shown an embodiment of a double overhead camshaft engine in accordance with the present invention. The engine comprises a cylinder block 1 to which a cylinder head 1 is bolted through a gasket (not shown). The engine is provided with a camshaft 5*a* for causing intake valves 3 to open and close, another camshaft 5*b* for causing exhaust valves 4 to open and close. The camshafts 5*a*, 5*b* are rotatably supported on or by the cylinder head 2. Sprockets 6*a*, 6*b* are respectively fixedly mounted on the camshafts 5*a*, 5*b* at one end section. A crank sprocket 8 is fixedly mounted on a crankshaft 7 projected from a crankshaft 7 from the front end section of the cylinder block 1.

Figure 2:
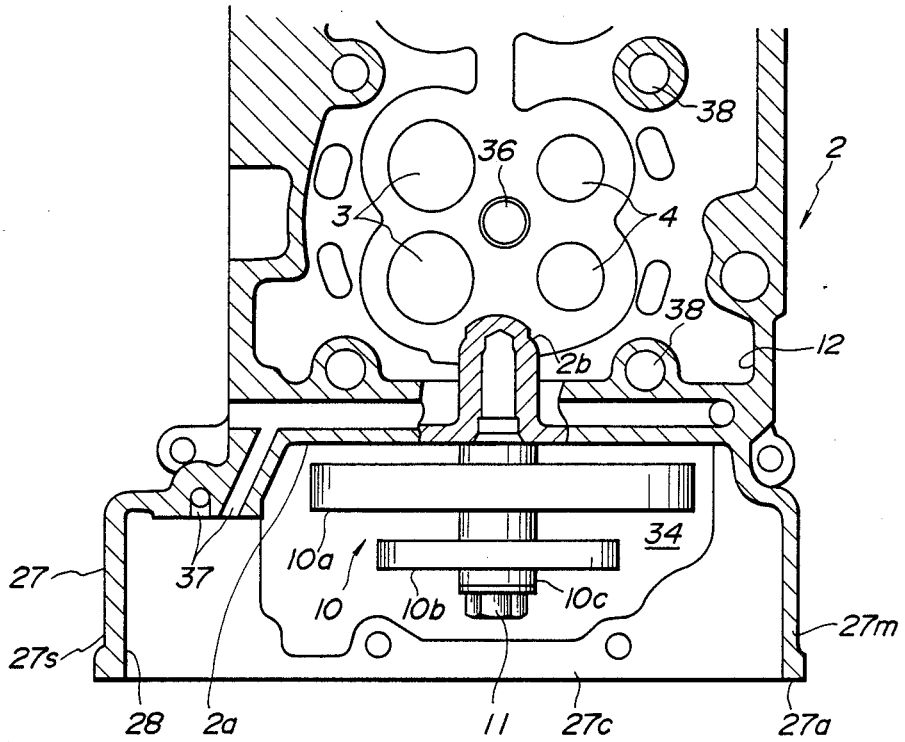
FIG. 2 is a fragmentary transverse sectional view of the engine of FIG. 1.

The idler gear 10 includes large and small diameter idler gears 10*a*, 10*b* which have a common hub section 10*c* rotatably mounted on an idler gear installation bolt 11. The idler gear installation bolt 11 is screwed into the front end section (face) 2*a* of the cylinder head 2 as shown in FIG. 2. It is to be noted that the idler gear installation bolt 11 is supported only to the cylinder head front end section 2*a*, taking a so-called cantilever arrangement. The threaded portion (no numeral) of the idler gear installation bolt 11 is embedded in a boss section 2*b* which extends inwardly from the front end wall (no numeral) of the cylinder head front end section 2*a* and located within an engine coolant passage 12.

A chain 13 is passed on the crank sprocket 8 of the crankshaft 7 and on the large diameter idler gear 10*a* to connect them. A chain 14 is passed on the smaller diameter idler gear 10*b* and on the sprockets 6*a*, 6*b* of the respective intake and exhaust valve camshafts 5*a*, 5*b* to connect them. The reference numerals 15, 16 designate movable chain guides, respectively, while the reference numerals 17, 18 designate fixed chain guides, respectively. The large diameter idler gear 10*a* has an outer diameter of two times that of the crank sprocket 8, so that the rotational speed of the idler gear 10 is ½ of that of the crankshaft 7. The small diameter idler gear 10*b* has the same diameter as the sprockets 6*a*, 6*b*, so that the camshafts 5*a*, 5*b* rotate at the same rotational speed as the idler gear 10. The large diameter idler gear 10*a* is provided with a timing mark 19 which is brought into agreement with a timing mark 20 of the chain 13 thereby accomplishing positioning between the large diameter idler 10*a* and the chain 13. The crank sprocket 8 is provided with a timing mark 21 which is brought into agreement with a timing mark 22 of the chain 13 thereby accomplishing positioning between the crank sprocket 8 and the chain 13. Additionally, the small diameter idler gear 10*b* is provided with a timing mark 23 which is brought into agreement with a timing mark 24 of the drive chain 14 thereby to accomplish positioning between the small diameter idler gear 10*b* and the drive chain 14. The sprockets 6*a*, 6*b* are respectively provided with timing marks 25*a*, 25*b* which are respectively brought into agreement with timing marks 26*a*, 26*b* of the drive chain 14 thereby accomplishing positioning among the sprockets 6*a*, 6*b* and the drive chain 14.

The cylinder head 2 is integrally formed at its front end section (face) 2*a* with a surrounding wall structure 27 which extends forward or in the direction of an axis of the idler gear 10. The surrounding wall 27 extends over the front end of the boss section 10*c* of the idler gear 10, so that the front end section 27*a* of the surrounding wall structure 27 is positioned forward of the front end of the idler gear installation bolt 11. The surrounding wall structure 27 includes two side wall sections 27*s*, 27*m* which are spaced from and opposite from each other. The side wall sections 27*s*, 27*m* are integral with the cylinder head front end section 2*a*. The front end section 27*a* of the surrounding wall structure 27 is integrally connected between the side wall sections 27*s*, 27*m* and defines an opening 28 which laterally extends. The front end section 27*a* includes a laterally extending portion 27*d* which also defines the opening 28. The lateral dimension of the opening 28 is larger than the outer diameter of the large diameter idler gear 10*a*. A cover 29 (shown in FIG. 3) is detachably attached to the front end of the surrounding wall structure 27 to close the opening 28, maintaining a seal between it and the surrounding wall structure 27. The cover 29 is formed with a plurality of through-holes 29*a* for bolts (not shown) to be screwed into the bolt holes 35 (in FIG. 1) at the front end section 27*a* of the surrounding wall structure 27. The upper face 2*c* of the cylinder head 2 and the upper face 27*b* of the surrounding wall structure 27 are in flush with each other and contiguous with each other. In other words, both the upper faces 2*c*, 27*b* are in the same flat plane.

Figure 3:
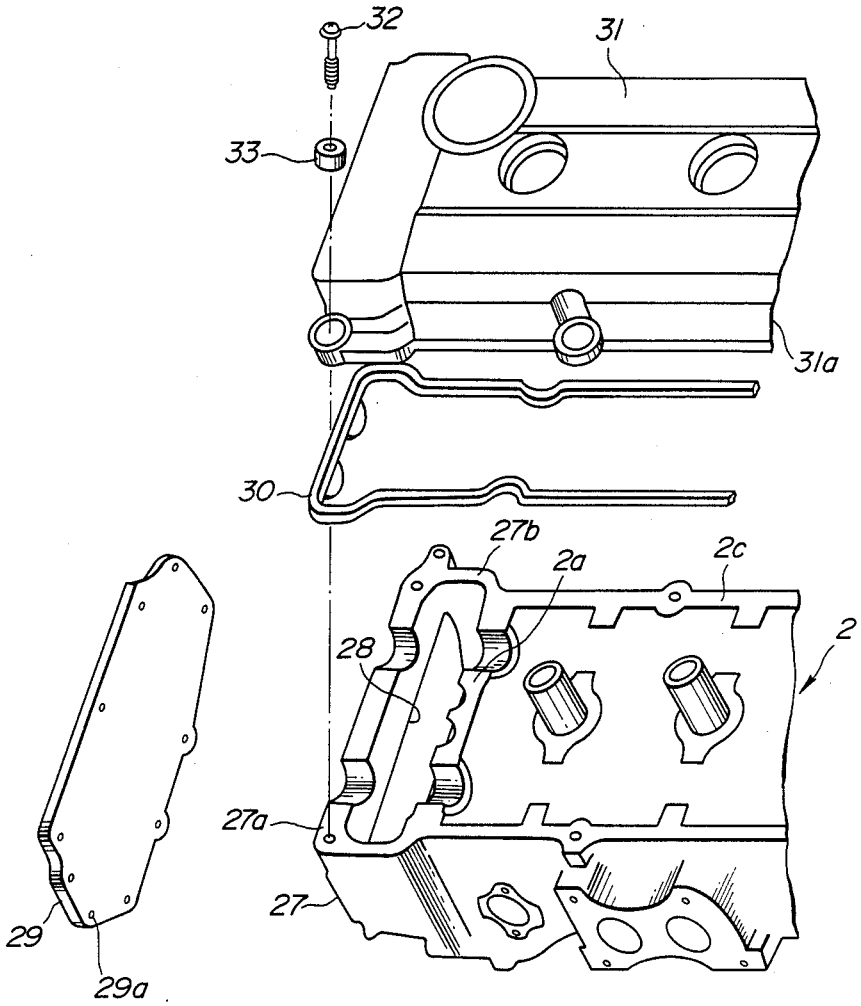
FIG. 3 is a fragmentary perspective view of the engine of FIG. 1.
Figure 4:
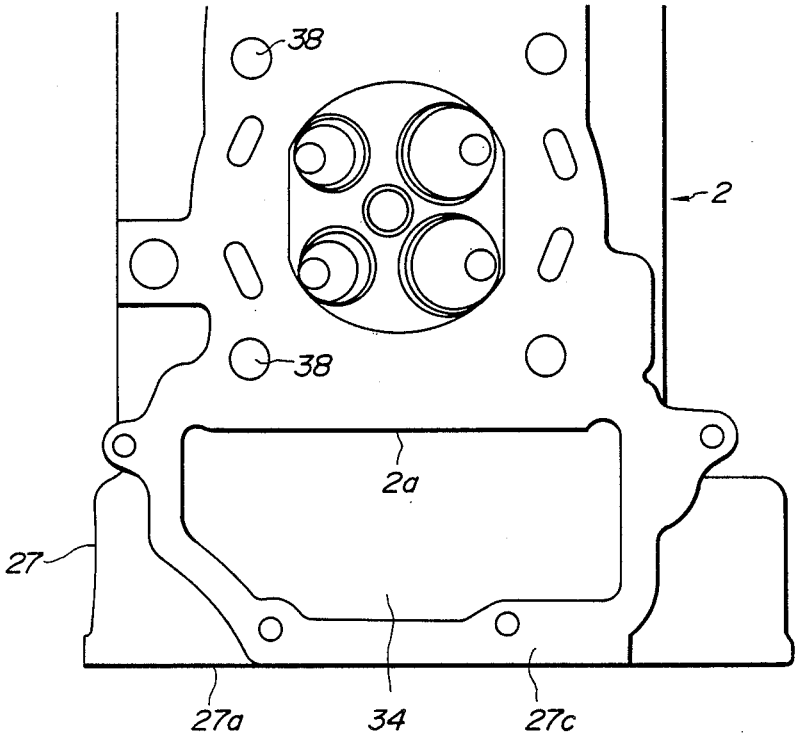
FIG. 4 is a bottom view of the cylinder head of the engine of FIG. 1.

In this connection, a rocker cover 31 has a bottom peripheral face 31*a* which is in a flat plane. The bottom peripheral face 31*a* of the rocker cover 31 is sealingly fixed through a gasket 30 to the upper faces 2*c*, 27*b* of the cylinder head 2 and the surrounding wall structure 27 by means of bolts 32 as shown in FIG. 3. The reference numeral 33 is an elastomeric member disposed between the bolt 32 and the rocker cover 31. It will be seen that a laterally wide opening is defined by the upper face 27*b* of the surrounding wall structure 27. The surrounding wall structure 27 includes a bottom wall section 27*c* which is formed with an opening 34 whose lateral dimension is larger than the outer diameter of the large diameter idler gear 10*a* as shown in FIG. 2. In FIG. 2, the reference numeral 36 designates a spark plug, 37 a lubricating oil passage, and 38 a bolt hole for a bolt (not shown) fastening the cylinder block 1 and the cylinder head 2.

The operation of the thus arranged engine will be discussed hereinafter.

During engine operation, the large diameter idler gear 10*a* rotates in the direction of an arrow B through the crank sprocket 8 and the drive chain 13 as the crankshaft 7 rotates in the direction of an arrow A. The larger diameter idler gear 10*a* rotates at a speed of ½ times that of the crankshaft 7. The small diameter idler gear 10*b* rotates together with the large diameter idler gear 10*a* as a single unit. The small diameter idler gear 10*b* drives the sprockets 6*a*, 6*b* through the drive chain 14, by which the intake valve camshaft 5*a* and the exhaust valve camshaft 5*b* rotate in the direction of an arrow C at the same speed as the small diameter idler gear 10*b*. As a result, the intake valve camshaft 5*a* and the exhaust valve camshaft 5*b* rotate at a speed of ½ times that of the crankshaft 7, so that the intake valve 3 and the exhaust valve 4 open and close at predetermined rotational positions (crank angles) of the crankshaft 7.

Next, assembling operation of the engine will be discussed.

First the idler gear 10 is put on the cylinder block 1 by using a certain tool under a state the timing mark 18 of the large diameter idler gear 10 is brought into agreement with the timing mark 19 of the drive chain 13. Then, the idler gear 10 with the drive chain 13 is brought into a space within the surrounding wall structure 27 through the opening 34 formed in the bottom wall section 27*c* of the surrounding wall structure 27. Thereafter, the cylinder head 2 is bolted to the cylinder block 1.

Subsequently, the idler gear installation bolt 11 is screwed into the front end section 2*a* of the cylinder head 2, in which such a screwing operation is made through the opening 28 formed at the front end section 27*a* of the surrounding wall structure 27. Additionally, the timing mark 23 of the small diameter idler gear 10*b* is brought into engagement with the timing mark 24 of the drive chain 14, and then the timing marks 25*a*, 25*b* of the sprockets 6*a*, 6*b* are respectively brought into agreement with the timing marks 26*a*, 26*b* of the drive chain 14, so that the sprockets 6*a*, 6*b* are fixedly mounted respectively on the intake valve chamshaft 5*a* and the exhaust valve camshaft 5*b*.

Since the lateral dimension of the opening 28 is larger than the outer diameter of the large diameter idler gear 10*a*, operation of installation of the idler gear installation bolt 11 and positioning between the idler gears 10*a*, 10*b* and the drive chains 13, 14 are securely carried out through the opening 28 formed at the front end section 27*a* of the surrounding wall structure 27. As a result, the opening and closing timings of the intake and exhaust valves 3, 4 can be accurately set at predetermined values.

The surrounding wall structure 27 extends from the cylinder head front end section 2*a* over the front end of the boss section 10*c* of the idler gear 10, and therefore the joining surface between the cylinder head 2 and the cover 29 is positioned outward or forward of the large and small diameter idler gears 10*a*, 10*b*. Accordingly, even when lubricating oil adhered to the large and small diameter idler gears 10*a*, 10*b* is splashed by centrifugal force generated by the idler gears 10*a*, 10*b*, the splashed lubricating oil does not strike against the joining surface of the cylinder head 2 and the cover 29 thereby preventing oil leak from the joining surface.

Since the idler gear installation bolt 11 is fixed only to the cylinder head front end section 2*a* in a so-called cantilever manner, the fixing installation of the idler gear installation bolt 11 is made regardless of the cover 29 for closing the opening 28. In other words, the idler gear installation bolt 11 is not supported to the cover 29 and therefore supported only to the cylinder head 2. This prevents lubricating oil leak which will occur in a conventional case the idler gear installation bolt (11) is also supported by the cover (29) in such a manner that one end section of the idler gear installation bolt is fitted in a hole formed in the cover (29).

Additionally, since the rear end section of the idler gear installation bolt 11 is embedded in the boss section **2*b* of the cylinder head front end section 2*a* projecting into the engine coolant passage 12, the hub section 10*c* of the idler gear 10 can be cooled through the idler gear installation bolt 11, thereby suppressing wear of the idler gear hub section 10*c*. Furthermore, since the lateral dimension of the opening 34 formed in the surrounding wall structure bottom wall section 27*c* is larger than the outer diameter of the large diameter idler gear 10*a*, the idler gear 10 with the drive chain passed thereon is brought through the opening 34 into the space within the surrounding wall structure 27 during assembly operation in which the cylinder head 2 is fixedly mounted on the cylinder block 1, thus largely shortening assembly time for the engine. Moreover, the upper faces 2*c*, 27*b* of the cylinder head 2 and the surrounding wall structure 27 are flush with each other and in a flat plane, and the bottom peripheral face 31*a* of the rocker cover 31 is in a flat plane. Besides, the gasket 30 of the rocker cover 31 is so shaped as to extend to the side of the surrounding wall structure 27, corresponding in shape to the upper face 27*b* of the surrounding wall structure 27. Consequently, a sufficient seal is maintained between the rocker cover 31 and the cylinder head 2 provided with the surrounding wall structure 27**.

Figure 5:
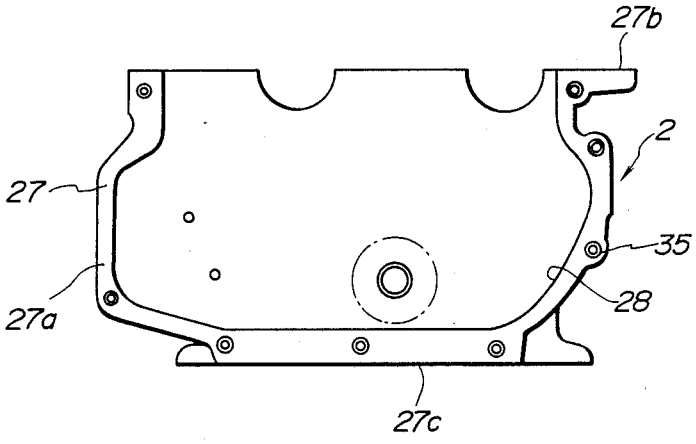
FIG. 5 is a front view of a modified example of a surrounding wall structure integrally formed at the front end section of the engine of FIGS. 1 to 4.

FIG. 5 illustrates modified example of the surrounding wall structure 27 similar to the above discussed embodiment with the exception that the laterally extending portion **27*d* in the front end section 27*a* is removed. In this example, the opening 28 extends upwardly to the upper face 27*b* of the surrounding wall structure. It will be understood that this example may provide the same advantageous effects as in the embodiment of FIGS. 1 to 4**.

What is claimed is:

1. A double overhead camshaft engine comprising:

a cylinder head by which two camshafts are rotatably supported;

an idler gear through which said two camshafts are drivably connected with a crankshaft of the engine by drive chains;

an idler gear installation bolt on which said idler gear is rotatably mounted, said idler gear installation bolt being fixedly secured only to a front end section of said cylinder head;

a surrounding wall structure disposed around said idler gear and extending from said cylinder head front end section in a direction of axis of said idler gear over said idler gear to form a front end section, said surrounding wall structure front end section defining an opening located on an opposite side of said cylinder head front end section with respect to said idler gear; and a cover detachably disposed to close said opening of said surrounding wall structure front end section, said cover being spaced from said idler gear installation bolt.

2. A double overhead camshaft engine as claimed in claim 1, wherein said surrounding wall structure is integral with said cylinder head front end section.

3. A double overhead camshaft engine as claimed in claim 1, wherein said opening of said surrounding wall structure front end section is located such that extension of said idler gear installation bolt passes through said opening.

4. A double overhead camshaft engine as claimed in claim 1, wherein said surrounding wall structure includes first and second side wall sections which are located on opposite sides of said idler gear, and a bottom wall section integrally connecting said first and second side wall sections and located below said idler gear.

5. A double overhead camshaft engine as claimed in claim 4, wherein said surrounding wall structure bottom wall section is formed with an opening whose lateral dimension is larger than outer diameter of said idler gear.

6. A double overhead camshaft engine as claimed in claim 1, wherein said opening of said surrounding wall structure front end section has a lateral dimension larger than outer diameter of said idler gear.

7. A double overhead camshaft engine as claimed in claim 1, wherein said idler gear has a hub section rotatably mounted on said idler gear installation bolt, wherein said surrounding wall structure front end section is positioned outward of a front end of said idler gear hub section, said front end being nearer to said surrounding wall structure front end section than a rear end of said idler gear hub section.

8. A double overhead camshaft engine as claimed in claim 1, wherein said idler gear includes first and second idler gears which are coaxial with each other and integral with a common hub section rotatably mounted on said integral with a common hub section rotatably mounted on said idler gear installation bolt, said first idler gear being larger in outer diameter than said second idler gear, said first idler gear being drivably connected through a drive chain with the crankshaft, said second idler gear being drivingly connected through a drive chain with said two camshafts.

9. A double overhead camshaft engine as claimed in claim 1, wherein said cylinder head front end section has a boss section to which a part of said idler gear installation bolt is embedded, said boss section extending into an engine coolant passage formed in said cylinder head.

10. A double overhead camshaft engine as claimed in claim 1, wherein said surrounding wall structure has an upper face which is flush with upper face of said cylinder head.

* * * * *